United States Patent [19]

Bayley

[11] 4,287,281

[45] Sep. 1, 1981

[54] MAGNETIC TONER COMPOSITION AND A METHOD OF MAKING THE SAME

[75] Inventor: Robert D. Bayley, Ontario, N.Y.

[73] Assignee: Xerox Corporation, Stamford, Conn.

[21] Appl. No.: 86,974

[22] Filed: Oct. 22, 1979

[51] Int. Cl.[3] ..... G03G 15/08

[52] U.S. Cl. ..... 430/107; 430/109; 430/137; 252/62.54

[58] Field of Search ..... 430/107, 109, 137; 252/518, 62.54

[56] References Cited

U.S. PATENT DOCUMENTS

| | | | |
|---|---|---|---|
| 3,080,318 | 3/1963 | Claus | 430/109 |
| 3,093,039 | 6/1963 | Rheinfrank | 430/109 |
| 3,345,294 | 10/1967 | Cooper | 430/107 |
| 3,796,664 | 3/1974 | Hayashi | 430/109 |
| 3,959,153 | 5/1976 | Sadamatsu et al. | 430/109 X |
| 4,071,670 | 1/1978 | Vanzo et al. | 526/88 |
| 4,097,620 | 6/1978 | Lu | 430/109 X |

FOREIGN PATENT DOCUMENTS

| | | | |
|---|---|---|---|
| 2538112 | 3/1976 | Fed. Rep. of Germany | 430/107 |

*Primary Examiner*—John D. Welsh

*Attorney, Agent, or Firm*—E. O. Palazzo; R. A. Guloch

[57] ABSTRACT

Magnetic toner compositions are prepared using two types of magnetic particles. The first type of magnetic particles have hydrophilic surface characteristics and the second type of magnetic particles have hydrophobic surface characteristics. Toner compositions are prepared by a dispersion polymerization technique wherein both types of magnetic pigment are dispersed in a vinyl monomer containing a polymerization initiator. This mixture of materials forms the discontinuous phase of a dispersion polymerization, the continuous phase being water containing a suspension stabilizing agent. The toner particles thus formed have the hydrophilic magnetic particles distributed on or near the surface of the toner particles while the hydrophobic magnetic particles are uniformly distributed throughout the remainder of the toner particles.

8 Claims, No Drawings

MAGNETIC TONER COMPOSITION AND A METHOD OF MAKING THE SAME

BACKGROUND OF THE INVENTION

This invention relates to toner compositions for use in the development of electrostatographic latent images and more particularly to magnetic toner compositions and to a method of preparing the same.

Magnetic toner particles have recently found application in the development of electrostatographic images as single component developers. Single component magnetic developers are particularly applicable in small copiers where size constraints are an important aspect since carrier materials are not required.

One problem that exists with regard to single component magnetic developers is that the electrical properties of the toner particles must be such that both the development of the latent electrostatic image and the transfer of the thus developed image to plain paper can be readily accomplished. Problems in this regard have resulted because the electrical resistivity of the toner particles themselves vary with respect to the type of magnetic particles employed, the quantity of the magnetic particles employed and the disposition of the magnetic particles within each of the toner particles.

It is desirable to prepare single component magnetic toner particles which are field dependent and thus can be developed by the inductive developing method, wherein the particles act as conductors, and subsequently transferred by electrostatic techniques wherein the toner particles act as insulators. In copending application Ser. No. 921,410 filed July 3, 1978, entitled *Single Component Magnetic Toner,* by Chin H. Lu, and assigned to the same assignee as the present application, a field dependent magnetic toner composition and a method of making the same is disclosed. In this technique, the resin containing coated magnetic particles is dissolved in a solvent therefor and spray dried to achieve field dependent toner particles. Unfortunately, spray drying is an expensive process and results in particles that exhibit poor flow properties in electrostatographic copying machines.

It is therefore desirable to provide improved field dependent magnetic toners having improved electrical characteristics, superior flow properties, and higher magnetic particle loading capabilities.

SUMMARY OF THE INVENTION

Magnetic toner compositions are prepared by a dispersion polymerization method wherein two types of magnetic particles are initially mixed with and dispersed into a vinyl monomer together with a polymerization initiator to form a discontinuous phase. This mixture is then rapidly stirred into an aqueous continuous phase containing a suspension stabilizing agent.

The first type of magnetic particle has hydrophilic surface characteristics and the second type of magnetic particle has hydrophobic surface characteristics. This results in a toner particle having the hydrophilic magnetic particles disposed near or at the surface thereof and the second type having hydrophobic surface characteristics are distributed uniformly throughout the remainder of the particle.

Thus, the invention resides in the use of two distinctly different types of magnetic particles in the preparation of single component magnetic developer by a suspension polymerization method.

In the preparation of the toner particles in accordance with this invention, any suitable particulate paramagnetic (that is, capable of being attracted by a magnetic) material may be used such as, for example, iron, iron oxide, nickel, nickel oxide, alloys of any of the above materials and mixtures thereof, magnetite and the like. The particle size of the magnetic material preferably should be as small as possible, however, the particles may be from about 0.01 to about 0.5 microns.

The hydrophilic magnetic particulate material will generally be the particulate material itself, without any coating thereon, however, it may be desirable to make the surface of the particles more hydrophilic by techniques such as, for example, treating the particles with a highly hydrophilic substance such as, for example, sodium lauroyl sulfate, N-cetyl N-ethyl morpholinium ethylsulfate, sodium stearate, titanium di(cumylphenolate) oxyacetate, titanium di(dioctylpyrophosphate) oxyacetate, isopropyl tri(dibutylpropophosphato) titanate and the like. The total weight of the magnetic particles based on the weight of the monomer present in the discontinuous or monomer phase is from about 40 to about 75 percent by weight and preferably from about 45 to about 55 percent by weight. The ratio of the magnetic particles having hydrophilic surface characteristics to magnetic particles having hydrophobic surface characteristics is from about 5:95 to about 95:5 and preferably from about 5:95 to about 35:65.

The second type of magnetic material, having hydrophobic surface characteristics, are particles which are coated with a hydrophobic agent such as, for example, fatty acid such as stearic acid, palmitic acid, sorbitan trioleate, glycerol monostearate, propylene glycol monostearate, ethylene glycol monostearate, glycerol monostearate, sorbitan monostearate, magnesium stearate, magnesium palmitate, barium stearate, barium oleate, manganese naphthanate, titanium butoxide, triethanolamine titanate, and the like.

To achieve the magnetic particles having hydrophobic surface characteristics, any of the above suitable hydrophobic agents may be coated onto the particulate magnetic material by any suitable known techniques such as, for example, fluid bed coating, solution coating, roll mill coating and the like.

The toner particles in accordance with this invention are prepared by a dispersion polymerization method wherein both types of magnetic particles are incorporated together with the monomer and a polymerization initiator in a discontinuous phase. That is, all of these three ingredients are mixed together to intimately disperse the polymerization initiator and the magnetic particles in the monomer. This can be done by any suitable mixing apparatus such as, for example, a Waring Blender. After adequate mixing is achieved, this discontinuous phase is rapidly dispersed under high shear into an aqueous or continuous phase which contains a suspension stabilizing agent. It is desirable in this step to agitate the suspension at high shear in order to achieve both uniform and sized monomer droplets in the aqueous continuous phase. Preferably, the droplets should have a size equal to the size of the toner particles desired, generally, from about 5 to about 35 microns. This eliminates the need for any subsequent reduction in particle size of the toner by grinding or the like. Polymerization is brought about by raising the temperature of the reaction mass. Temperatures in excess of 50° C.

and generally from about 70° C. to about 90° C. are employed to bring about the polymerization. Subsequent to completion of the reaction the completed toner particles are recovered by suitable techniques such as washing and filtration, decanting, centrifuging or the like.

In the preparation of the monomer or discontinuous phase, any suitable vinyl monomer may be employed such as, for example, esters of saturated alcohols with mono and polybasic unsaturated acids, such as, alkyl acrylates and methacrylates, haloacrylates, diethyl maleate, and mixtures thereof; vinyl and vinylidene halides such as vinyl chloride; vinyl fluoride, vinylidene chloride, vinylidene fluoride, tetrafluoroethylene, chlorotrifluoroethylene and mixtures thereof; vinyl esters such as vinyl acetate, unsaturated aromatic compounds such as styrene and various alkyl styrenes, alphamethyl styrene parachlorostyrene, parabromostyrene, 2,4-dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile, haloacrylonitrile, phenylacrylonitrile, vinylidene cyanide, and mixtures thereof; N-substituted unsaturated amides such as N,N dimethyl acrylamide, N-methyl acrylamide, and mixtures thereof; conjugated butadienes such as butadiene, isoprene and mixtures thereof; unsaturated ethers such as divinyl ether, diallyl ether, vinyl alkyl ether and mixtures thereof; unsaturated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinyl coumarone, N-vinyl carbazole, and mixtures thereof; unsaturated alicyclic compounds such as vinyl-cyclopentane, vinyl-cyclohexane and mixtures thereof; unsaturated thio compounds such as vinyl thio-ethers; unsaturated hydrocarbons such as ethylene, propylene, coumarone, indene, terpene, polymerizable hydrocarbon fractions, isobutylene and mixtures thereof; alkyl compounds such as alkyl alcohol, allyl esters, diallyl phthalate, triallylcyanurate and mixtures thereof. Any suitable mixture of copolymerizable monomers of the type described above can also be used in the process of this invention.

Any suitable polymerization initiator may be used to bring about the polymerization of the monomer such as, for example, azobisisobutyronitrile (AIBN), benzoyl peroxide, methylethyl ketone peroxide, isopropyl peroxycarbonate, cumene hydroperoxide, 2,4-dichloryl benzoyl peroxide, lauroyl peroxide and the like. Generally, from about 0.5 to 5 percent initiator based on the weight of the monomer is sufficient.

Any suitable stabilizing agent for incorporation into the aqueous phase may be used such as, for example, polyvinyl alcohol, gelatic, methyl cellulose, methylhydroxypropylcellulose, ethyl cellulose, sodium salt of carboxy methyl cellulose, polyacrylate acids and their salts, starch, gums, alginates, zein, casein, tricalcium phosphate, talc, barium sulfate, bentonite and the like. The stabilizing agent is present in the continuous phase in a stabilizing amount, preferably from about 0.1 to about 1 percent by weight and most preferably in an amount from about 0.1 to about 0.4 percent by weight.

If it is desired, other suitable coloring agents may be added to the monomer phase in order to achieve the proper color of the toner particles such as, for example, carbon black, suitable dyes, pigments and the like.

By utilizing the procedure in accordance with this invention, toner particles are achieved which have the hydrophilic particles at or near the surface thereof and the hydrophobic particles substantially uniformly dispersed throughout the remainder of the particle. This configuration permits the excellent electrical properties obtained in accordance with this invention. Further, the conductivity of the particles as exhibited by the voltage breaking point can be controlled by the amount of magnetic material having hydrophilic surface characteristics without substantially altering the field dependent nature of these toner particles. This value, which changes toward being more conductive as more hydrophilic material is added establishes that the hydrophilic material is disposed on the surface of the particles.

The invention is further illustrated by the following examples in which part are by weight unless otherwise specified:

EXAMPLE I-CONTROL

About 400 parts of styrene and about 325 parts of magnetite having a particle size of about 0.01 to 0.2 microns are mixed together in a blender equipped with a high shear mixing device such as a Polytron head, for about 20 minutes during which the temperature was permitted to reach approximately 50° C. The temperature permitted the ready and uniform dispersion of the magnetite in the styrene monomer. The magnetite was previously coated in a fluidized bed with stearic acid, the quantity of stearic acid present on the particles of magnetite being about 0.68 percent by weight based on the weight of the magnetite.

About 28 parts of lauroyl peroxide are stirred into the monomer containing the magnetite to achieve a uniform mixture. About 120 parts of this slurry are added to about 600 parts by volume of a 1.5 percent polyvinyl alcohol solution in water in a Waring Blender equipped with a polytron head. Rapid agitation is conducted until the droplet size of the discontinuous phase in the aqueous continuous phase is approximately 15 microns. The reaction mass is transferred to a reaction chamber having a paddle blade stirer set at about 100 revolutions per minute and the temperature is maintained at about 70° until polymerization is complete. After completion, the contents of the reaction chamber are emptied into a container to which 3,000 parts by volume of water are added. The toner particles settle to the bottom of the container and the supernatant liquid is poured off. The thus separated toner particles adhere loosely together and are broken up and passed through a 45 micron sieve. The toner as separated exhibited field dependence and a voltage break point of about 15,000 volts per centimeter.

EXAMPLE II

The procedure of Example I is repeated with the exception that about 290 parts of the same coated magnetite are utilized together with about 35 parts of uncoated magnetite. The procedure is identical to that of Example I. The resulting toner exhibits the same field dependence but has a voltage breaking point of about 8500 volts per centimeter. This indicates that these particles are more conductive.

EXAMPLE III

The procedure of Example I is repeated except that about 250 parts of coated magnetite and about 75 parts of uncoated magnetite are employed. The completed toner exhibits field dependence and a voltage breakdown of about 6000 volts per centimeter.

EXAMPLE IV-CONTROL

Example I is repeated using about 325 parts of uncoated magnetite. The voltage breakdown is about 1000 volts per centimeter.

It is to be understood that any of the components and conditions mentioned as suitable herein can be substituted for its counterpart in the foregoing examples. Variations will be apparent to those skilled in the art.

What is claimed is:

1. A magnetic toner composition comprising particles, said particles comprising resin and magnetic particles dispersed within the resin, said magnetic particles being of two types, the first type having hydrophilic surface characteristics and the second type having hydrophobic surface characteristics.

2. The magnetic toner composition of claim 1 wherein the ratio by weight of the first type hydrophilic magnetic particles to the second type hydrophobic magnetic particles is from about 5:95 to about 95:5.

3. The magnetic toner composition of claim 2 wherein the ratio is from about 5:95 to about 35:65.

4. The magnetic toner composition of claims 1 or 3 wherein the total concentration of magnetic particles in the toner composition is from about 40 to about 75 percent by weight based on the weight of the resin.

5. The magnetic toner composition of claims 1 or 3 wherein the total concentration of magnetic particles in the toner composition is from about 45 to about 55 percent by weight based on the weight of the resin.

6. The magnetic toner composition of claim 1 wherein the first type magnetic particles having hydrophilic surface characteristics is uncoated magnetite.

7. The magnetic toner composition of claim 1 wherein the second type magnetic particles having hydrophobic surface characteristics is magnetite coated with a hydrophobic agent.

8. The magnetic toner composition of claim 1 wherein the first type magnetic particles having hydrophilic surface characteristics are located near the surface of the toner particles and the second type magnetic particles having hydrophobic surface characteristics are uniformly distributed throughout the remainder of the particles.

* * * * *